United States Patent [19]

Khomyakov et al.

[11] 3,952,493

[45] Apr. 27, 1976

[54] APPARATUS FOR RINGLESS SPINNING OF FIBERS

[76] Inventors: Igor Stepanovich Khomyakov, ulitsa Sovetskaya, 125, kv. 23; Albert Arturovich Leinek, ulitsa Sovetskaya, 111, kv. 39, both of Kostroma, U.S.S.R.

[22] Filed: Feb. 20, 1974

[21] Appl. No.: 444,113

[52] U.S. Cl. ..... 57/58.89

[51] Int. Cl.[2] ..... D01H 1/12

[58] Field of Search .....57/58.89–58.95, 56

[56] References Cited

UNITED STATES PATENTS

| | | | |
|---|---|---|---|
| 3,038,293 | 6/1962 | Pavek | 57/58.93 |
| 3,038,294 | 6/1962 | Pavek | 57/58.93 |
| 3,119,223 | 1/1964 | Meimberg | 57/58.95 X |
| 3,127,730 | 4/1964 | Pavek et al. | 57/58.91 |
| 3,210,923 | 10/1965 | Schlosser | 57/58.95 |
| 3,357,168 | 12/1967 | Zlevor et al. | 57/58.89 |
| 3,360,917 | 1/1968 | Kubovy et al. | 57/58.95 |
| 3,457,716 | 7/1969 | Storek et al. | 57/58.89 |
| 3,798,886 | 3/1974 | Rajnoha et al. | 57/56 |

*Primary Examiner*—John Petrakes

*Attorney, Agent, or Firm*—Fleit & Jacobson

[57] ABSTRACT

The apparatus includes a driven spinning bowl with an inclined frustoconical internal surface and with a base having air vents made therethrough to create suction within this bowl, this suction drawing fibres along the inclined surface into the trough of the bowl. The trough is defined by the inclined surface and a plurality of pins having ends thereof secured to this inclined surface about the entire circumference of the bowl and spaced so as to provide passage of unspinnable fibres and dust therebetween, the unspinnable fibres and dust being subsequently removed through apertures made in the inclined surface below these pins. The provision of the pins and their spacing provide for cleaning of the bowl from unspinnable fibres and dust directly in the course of the spinning operation, without interrupting operation.

5 Claims, 3 Drawing Figures

APPARATUS FOR RINGLESS SPINNING OF FIBERS

The present invention relates to pneumatic spinning machines and, more particularly, to apparatus for ringless spinning of fibre.

The present invention may be utilized with utmost effectiveness for producing spun yarn of medium and low counts from chemical stable fibres, flax fibres and blends of the above fibres with woollen fibres.

There is known apparatus for continuous ringless spinning of staple fibres, comprising a driven bowl with an inclined internal surface of a frustoconical shape, the bowl being associated with a lid and having a base with ventilation openings or air vents adapted to create suction interiorly of the bowl, this suction drawing separate fibres into the bowl from a pipe mounted in the lid, along the inclined surface into the annular trough of this bowl defined by the inclined internal surface of the bowl and the base, the latter also being of a frustoconical shape including an inclined surface, the two inclined surfaces being movable axially relative to each other.

The said trough of the bowl is intended for collecting therein the separate fibres and for forming them into a thin sliver delivered from the bowl as spun yarn via a tube mounted in the lid (cf. Czechoslovakian Pat. No. 129,437).

The trough defined by the abovementioned inclined surfaces accummulates therein during a spinning dust and unspinnable fibres, which may result in an increased rate of breakage of the yarn, and, eventually, in the necessity of discontinuing the spinning operation. To remove the accummulated dust, the bowl has to be stopped (which means that the spinning operation is discontinued), whereafter the dust is mechanically removed from the bowl.

Alternatively, the accummulated dust may be removed by moving the base away from the inclined surface of the bowl, to transform the trough into an annular gap through which the dust is removed. However, even this operation has a disadvantage, because the spinning operation is to be discontinued, no matter for how brief a period; in order to resume the spinning operation, an automatic yarn end linking mechanism is to be operated, to say nothing of the fact that additional mechanisms are required for forming the annular gap, which complicates the structure of the apparatus.

It is an object of the present invention to provide an apparatus for ringless spinning of fibre, that would make for continuous spinning operation.

It is an important object of the present invention to provide an apparatus combining a continuous spinning operation with simultaneous removal of unspinnable fibres and dust.

It is still another object of the present invention to provide an apparatus of a simple design, requiring no additional cleaning appliances.

These and other objects are attained in an apparatus for ringless spinning of fibres, comprising a driven spinning bowl having an inclined internal surface of a frustoconical shape, the bowl being associated with a lid and having a base with ventilation openings or air vents adapted to create suction interiorly of this bowl, to draw individual fibres from a pipe arranged in the lid along the inclined surface into the annular trough of this bowl, this trough being adapted to accummulate these fibres therein and to form from them a thin sliver delivered from the bowl as spun yarn via a tube mounted in the lid, in which apparatus, in accordance with the present invention, this annular trough is defined by the inclined internal surface of the bowl and by a plurality of pins mounted at the same level by the similar ends thereof on said inclined surface about the entire circumference of the bowl, these pins being spaced so that the space left intermediate of any adjacent pair of the pins is sufficient for passage therethrough of unspinnable fibres and dust which are removed from the bowl via apertures provided in said surface below the pins.

The above structure of the apparatus makes for continuous cleaning of the trough throughout the spinning operation from dust and unspinnable fibres, owing to the provision of the spaces intermediate of the pins and of the ventillation apertures made therebelow in the inclined surface of the bowl, the cleaning not involving any additional devices for the purpose.

To better straighten the fibres engaging the pins, particularly, woollen fibres, it is advisable that the free ends of these pins should be directed toward the axis of rotation of the bowl.

To facilitate assembling of the apparatus, it is advisable that said pins should be needle-shaped.

To step up the reliability of the securing of the pins, it is advisable that the free ends thereof should be attached to an annular shoulder provided on the base of the bowl and projecting interiorly of this bowl, wherein.

Figure 1:
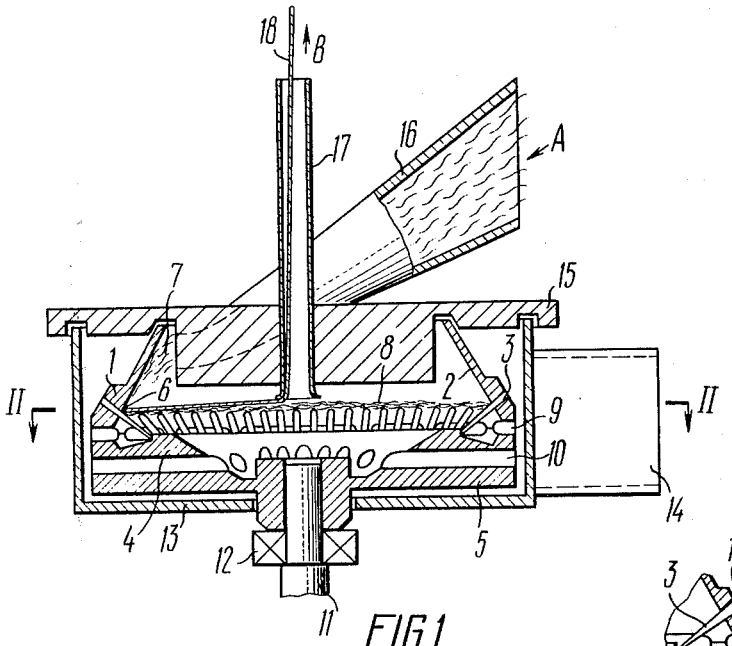
FIG. 1 is a cross-sectional side view of an disclosed apparatus for ringless spinning of fibre.
Figure 2:
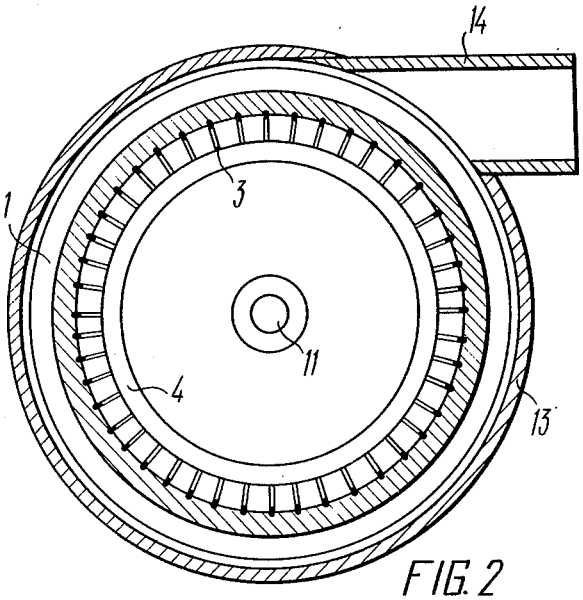
FIG. 2 is a sectional view along line II—II of FIG. 1.

Referring now to the appended drawings, the apparatus includes a driven spinning bowl 1 (FIG. 1) having an inclined internal surface 2 of a frustoconical shape and a plurality of pins 3 arranged so that the space left intermediate of any adjacent pair of the pins is sufficient for passage therethrough of unspinnable fibres and dust. These pins are directed toward the axis of rotation of the bowl 1, as shown in FIG. 2.

Figure 3:
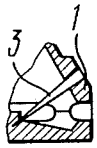
FIG. 3 is a sectional view of a needle-shaped pin.

The pins 3 are secured at their ends to the inclined surface 2 at the same level about the entire circumference of the bowl 1. The opposite, free ends of the pins 3 are secured in an annular shoulder 4 provided on a base 5 of the bowl and projecting into this bowl 1. To facilitate assembly of the apparatus, the pins 3 are needle-shaped, as shown in FIG. 3. The ends of the pins 3, secured to the inclined surface 2, define with this surface a trough 6 (FIG. 1) adapted to accummulate therein separate fibres 7 and to form from these fibres a thin sliver 8.

Positioned below the pins 3 are apertures 9 made in the inclined surface 2, through which the flow of the outgoing air draws therewith from the bowl 1 dust and unspinnable fibres. In the base 5 of the apparatus there are ventilation openings or air vents 10 adapted to create suction interiorly of the bowl at rotation of the latter.

The spinning bowl is mounted on a spindle 11 for rotation in bearing means 12 by any suitable drive. The bowl 1 is enclosed within a casing 13 associated with an outlet pipe 14 and with a lid 15 including a pipe 16 through which separate fibres are supplied into the bowl, as well as a tube 17 through which spun yarn is delivered from the bowl. The outlet tube 14 is adapted to be connected to an air manifold (not shown) in any suitable known manner for further transportation of the air with dust and unspinnable fibres from the bowl. Separation of the fibres and their feeding into the pipe 16, as well as delivery of the spun yarn 18 from the spinning bowl 1 are effected in any suitable known manner. The direction of feeding of the fibres is indicated in FIG. 1 with an arrow "A", while that of delivery of the spun yarn is indicated in the same drawing with an arrow "B".

OPERATION OF THE APPARATUS

The spindle 11 is rotated together with the bowl 1 mounted thereon. The action of the centrifugal forces due to the air vents 10 and partially to the apertures 9, results in suction being created interiorly of the bowl 1, whose value depends on the angular speed of the bowl 1. The suction draws a flow of air through the pipe 16 into the bowl. This flow of air takes therewith separate fibres 7 and conveys them onto the inclined surface 2 of the rotating bowl 1. The engagement of the fibres 7 with the inclined surface 2 changes the motion of the fibres to a rotary motion, whereby the fibres are acted upon by the centrifugal force.

The action of the centrifugal force straightens the fibres 7, and the latter tend to acquire a position circumferentially of the inclined frustoconical surface 2, whereby the same centrifugal force makes them slide down this surface 2 into the trough 6, where the superimposed fibres form a thin sliver 8.

As the end of already spun yarn 18 is introduced initially into the bowl 1, via the tube 17, the sliver 8 is broken and its end is connected to the end of the yarn, whereafter the spinning operation is started, with the spun yarn being delivered in the direction indicated with the arrow "B". In the course of the spinning process, the sliver 8 being drawn from the trough 6 is broken off and starts spinning, whereby twisting of the yarn is effected. Owing to the twisting and withdrawal of the yarn 18, the trough 6 is continuously cleaned from dust and unspinnable fibres at the area where the pins 3 are secured to the inclined surface 2. The action of the centrifugal force drives the dust and unspinnable fibre through the spaces intermediate of the pins 3, the dust and the unspinnable fibres sliding down the inclined surface 2 and being propelled by the outflowing air into the apertures 9, where this outflowing air conveys them through the outlet pipe 14 into the manifold (not shown).

What is claimed is:

1. An apparatus for ringless spinning of fibres comprising, in combination, a rotatably mounted spinning bowl having a side wall, said bowl side wall being provided with an inwardly inclined, inner surface of frustoconical shape, a circumferentially extending row of downwardly inclined pins mounted in their upper ends on said side wall inner surface with a lower portion of said inner surface extending below said row of pins to define with said inner surface a circumferentially extending trough, said pins being arranged in a uniform, spaced-apart relationship to permit the passage therethrough of unspinnable fibres and dust only, said side wall being provided with a plurality of circumferentially spaced, radially extending apertures having inner ends opening into said inner surface wall portion below said row of pins, means for introducing fibres into said bowl, means for rotating said bowl to draw fibres through said introducing means into said bowl and to deposit said fibres in said trough in the form of a sliver whereby unspinnable fibres and dust are moved downwardly along said inclined inner surface through the passages between said pins and into said apertures for discharge from said bowl by the centrifugal forces generated by the rotation of said bowl and means for conducting said sliver out of said bowl in the form of spun yarn.

2. Spinning apparatus in accordance with claim 1 including a base on said bowl and wherein the lower ends of said pins are secured to said base.

3. Spinning apparatus in accordance with claim 2 wherein said base is provided with a plurality of radially extending apertures for creating suction within the interior of said bowl during the rotation of said bowl to draw said fibres through said introducing means into said bowl.

4. Spinning apparatus in accordance with claim 3 including a casing disposed in surrounding coaxially spaced relationship with said bowl, a lid on said casing and wherein said yarn conducting means and said fibre introducing means are mounted on said lid and an outlet tube on said casing in communication with the interior of said casing for conducting air with said unspinnable fibres and dust carried thereby from the interior of said casing exteriorly of said casing during the rotation of said bowl.

5. An apparatus as claimed in claim 1, wherein said pins are needle-shaped.

* * * * *